US009016402B2

(12) United States Patent
Thorne

(10) Patent No.: US 9,016,402 B2
(45) Date of Patent: Apr. 28, 2015

(54) GEOLOGICAL DRILL

(76) Inventor: Garry Thorne, East St. Paul (CA)

( * ) Notice: Subject to any disclaimer, the term of this patent is extended or adjusted under 35 U.S.C. 154(b) by 641 days.

(21) Appl. No.: 13/227,883

(22) Filed: Sep. 8, 2011

(65) Prior Publication Data

US 2013/0062126 A1 Mar. 14, 2013

(51) Int. Cl.
*E21B 7/02* (2006.01)

(52) U.S. Cl.
CPC .. *E21B 7/027* (2013.01); *E21B 7/02* (2013.01)

(58) Field of Classification Search
CPC ..... E21B 7/02; E21B 7/027
USPC ..... 175/122, 162, 170; 405/421
See application file for complete search history.

(56) References Cited

U.S. PATENT DOCUMENTS

| | | | | | |
|---|---|---|---|---|---|
| 2,969,121 | A * | 1/1961 | Wallace | 173/33 |
| 3,212,591 | A * | 10/1965 | Tucker | 173/149 |
| 3,596,722 | A * | 8/1971 | Allard | 175/93 |
| 3,670,832 | A * | 6/1972 | Striegler | 175/57 |
| 3,886,999 | A * | 6/1975 | Appleman | 173/159 |
| 3,912,024 | A * | 10/1975 | Richmond et al. | 173/152 |
| 4,298,073 | A * | 11/1981 | Yates | 173/198 |
| 4,553,612 | A * | 11/1985 | Durham | 175/122 |
| 4,585,080 | A * | 4/1986 | Bender | 175/170 |
| 4,809,788 | A * | 3/1989 | Nelson | 173/28 |
| 5,794,724 | A * | 8/1998 | Moller | 175/170 |
| 5,873,421 | A * | 2/1999 | Assenza | 175/121 |
| 6,298,928 | B1 * | 10/2001 | Penchansky | 175/162 |
| 6,431,286 | B1 * | 8/2002 | Andreychuk | 166/384 |
| 6,497,296 | B1 * | 12/2002 | McGriff et al. | 175/62 |
| 6,675,916 | B1 * | 1/2004 | Mathews | 175/162 |
| 7,810,554 | B2 * | 10/2010 | Wood et al. | 166/77.2 |
| 8,002,048 | B2 * | 8/2011 | Saehn et al. | 173/184 |
| 8,087,473 | B2 * | 1/2012 | Osadchuk et al. | 173/1 |
| 2003/0051883 | A1 * | 3/2003 | Seneviratne | 166/380 |
| 2009/0095491 | A1 * | 4/2009 | Wood et al. | 166/384 |
| 2009/0285638 | A1 * | 11/2009 | Lundberg et al. | 405/259.1 |
| 2010/0243327 | A1 * | 9/2010 | Wrede et al. | 175/57 |
| 2010/0270084 | A1 * | 10/2010 | Anderson et al. | 175/170 |
| 2011/0280104 | A1 * | 11/2011 | McClung, III | 367/82 |
| 2012/0125693 | A1 * | 5/2012 | Banjo et al. | 175/170 |
| 2012/0211281 | A1 * | 8/2012 | King | 175/57 |
| 2012/0247835 | A1 * | 10/2012 | Bohm et al. | 175/57 |

* cited by examiner

*Primary Examiner* — Brad Harcourt
*Assistant Examiner* — David Carroll
(74) *Attorney, Agent, or Firm* — Adrian D. Battison; Ade & Company Inc.

(57) ABSTRACT

A compact, portable, hydraulically controlled and operated drill for both soil augering and rock drilling includes a trailer type drill carrier. A mast is attached to the rear of trailer which is hydraulic controlled, lightweight and provides an adjustable drilling angle. A motor box housing unit is mounted for sliding movement on the mast with quick change capability for hydraulic drive motors specific for the soil augering drilling application requiring higher torque, lower rotation speeds for soil augering or lower torque, high rotation speed for rock coring. The motor housing carries a thrust bearing and a coupling to the drill string and is driven along a drive axis by a fully adjustable drilling penetration rate hydraulic cylinder.

8 Claims, 6 Drawing Sheets

GEOLOGICAL DRILL

GEOLOGICAL DRILL

This invention relates to an apparatus for use in geological exploration.

BACKGROUND OF THE INVENTION

This invention provides a drill which is directly applicable to geologic or geotechnical investigations where information and data on soil or rock are required. In particular, the arrangement described herein provides a portable, lightweight and mobile drill with capability for both efficient soil augering and rock coring, typically in remote areas where most mineral exploration is carried out; where access is limited due to non existent or limited road access; where low load-bearing soils typically cannot support heavy equipment, and other features such as dense bush, swamps and steep slopes make access difficult or impossible. This drill can also be used for other applications such as geotechnical (engineering), shallow groundwater and soil investigations.

In mineral exploration, soil sampling of overburden deposits where soils are overlying rock, also often referred to as till sampling, is increasingly being used as a tool in the search for minerals, precious stones and precious metals. This is due to a number of factors, including advancements in knowledge of mineral deposit features and relationship to glaciation, the capability of analytical laboratories to conduct and provide concise details on soil grain properties and composition and the increased costs of completing traditional core drilling investigations such as diamond drilling. Soil sampling and the subsequent analytical data can be used to improve understanding of surficial geologic environments which may provide important clues to the presence of underlying mineral deposits such as nickel, copper or precious stones such as diamonds.

Soil sampling for mineral exploration can be conducted using a variety of methods. The general purpose, however, is the same: to obtain a representative sample of soil and use the properties and composition to assist in gaining knowledge of the surface features and underlying hard rock environment.

Hand trenches, normally less than one meter width and less than two meters depth can be hand dug in overburden covered areas to expose the underlying bedrock for additional observation or rock sampling of the potential mineralized zone. This type of investigation is labour intensive, difficult, time consuming and often provides a rather limited exposure (view) of the bedrock. A similar type of excavation, known as borrow pits are also used for subsurface investigations.

At some locations, hand angering of boreholes typically 10-20 cm in diameter and up to a few meters depth is possible for reconnaissance type mineral investigations. However, this is also labour intensive and additional problems such as hole caving and intersection of pebbles or stones make it difficult to auger and sample at some locations.

Backhoe trenches, where possible, provide additional ease, depth and amount of exposure of bedrock compared to hand trenching. Most regular sized backhoes can provide trench or pit depths of 5-7 m and are often necessary where "channel" sampling, that is rock cut with a diamond blade and power saw, across a vein or in a sulphide exposure is required. However, due to the weight of such equipment, lack of roads, soft soils etc. it is often impractical to transport and use a backhoe for reconnaissance style or "quick look" prospecting at most locations where mineral exploration is conducted.

Augered boreholes using a machine driven auger can also be used. The surficial deposits that cover the underlying bedrock are variable dependent on the location and geologic processes that occurred in different regions. However, for much of Canada deposits of till, that is a mix of clay, silt, sand, gravel, cover the underlying bedrock. As glaciers advanced from Canada's north, large quantities of bedrock were gouged and the material imbedded in the ice only to be deposited at other locations as the glaciers retreated. Generally, the glacier advance directions can be determined from striations (gouges) in the bedrock. It is mainly the sampling and analysis of these till deposits that can provide prospectors with important clues as to the potential location of valuable ore deposits and precious stones such as diamonds. However, for large regions of the country, the till directly lying on bedrock is covered by lake sediments, of mainly clay and silt, which vary from 0 to 10's of m in depth. To obtain samples of the till overlying the bedrock, boreholes must first drilled through the sediments and then into the till.

The most efficient, cost effective and practical method for till prospecting is the recovery of soil samples using conveyor augers. Conveyor augers refer to the coupling of one auger onto another to form a continuous spiral that augers into soils and delivers the soil to ground surface where it can be sampled. These samples are also often referred to as "auger returns".

On mineral claims or other prospective mineral areas, successful mineral zone delineation often requires numerous test boreholes, sometimes hundreds. Therefore, it is cost effective and time saving to have a lightweight, portable and mechanized soil drill for augering boreholes for till prospecting in remote locations.

Core Sampling or "Diamond Drilling" is also desirable in many cases. While most of Canada is covered by soil deposits, there are also areas where bed rock is near or exposed at surface and prospecting for minerals can be conducted by methods such as direct observation and sampling, geophysical measurements of rock properties and coring or diamond drilling into the bedrock. Coring is also referred to as "Diamond drilling" because the bits used to cut into the hard bedrock have diamonds encased in a metal matrix. Diamond is the hardest mineral and is best suited for use in drill bits for efficient coring of the softer rocks. Diamond drilling to test the rock is an important and necessary procedure for determining the concentration and quantity of mineralization and is used to determine if mineralized zones warrant additional exploration and expenditure. The procedure is more complex than soil augering and sampling and is normally completed after other less costly soil and surface rock sampling, geophysical surveys, and other tests have been completed to increase the chances of intersecting a prospective mineral zone with the diamond drilled boreholes.

Diamond drills consist of a power unit, normally diesel or gasoline engines, which engages a clutch and transmission unit, which in turn rotates the drill string consisting of: flush jointed drill rods that are coupled together; a core barrel; and a reaming shell with a diamond bit. The cylinder of cut rock or core advances into the core barrel as drilling progresses. The bit and core barrel and rods are rotated at higher speeds compared to soil augering and the drill cuttings are returned to surface by pumping water into the drill rods, core barrel and diamond bit. The rods are withdrawn from the borehole at regular intervals as the core barrel is filled with core. The core is retained in core boxes for a record of the type of rock intersected by the borehole.

As such, diamond drilling an important part of the exploration for minerals and a portable drill that has coring capability, in addition to soil augering is most useful for prospecting and exploration in remote areas.

SUMMARY OF THE INVENTION

According to the invention there is provided an apparatus for use in geological exploration comprising:

a transport vehicle;

a mast carried on the vehicle having a base of the mast arranged to be located at the ground;

a hydraulic motor carried in a motor housing mounted for sliding movement along the mast;

a hydraulic cylinder connected to the motor housing at one end and to a top bracket of the mast at the other end for driving the housing in the sliding movement;

a pump driven by an engine both carried on the vehicle for supplying hydraulic fluid to the hydraulic motor;

a coupling extending along a drive axis downwardly from the housing and driven by the hydraulic motor;

the coupling being arranged for releasable attachment to an auger for driving along the auger along the drive axis into the ground for extracting an augered soil sample and being arranged for releasable attachment to a diamond core drill for drilling into the ground along the drive axis to extract a core sample.

Preferably there is provided a first motor for the auger and a second motor for the drill where the first motor has a lower rate of rotation and higher torque than the second motor so that the motor is changed when changing from the auger to the drill.

Preferably the motor housing includes an inner motor support into which the motor can be inserted for the quick change operation.

Preferably the motor housing includes a transverse mounting plate onto which the motor is mounted and includes a bottom mounting plate parallel to and spaced from the transverse plate to form a compartment for containing a flexible coupling, commonly known as a spider coupling, for the motor which flexes sufficiently to allow slight misalignment between the motor shaft and the driven element.

Preferably the motor housing includes a bottom plate onto which is mounted a thrust bearing for receiving thrust forces from the coupling when driving the auger or the drill.

Preferably the motor housing is mounted for pivotal movement about an axis along the mast so as to move the housing and the motor therein away from the drive axis to allow upward pulling of the auger or drill along the drive axis for extraction.

Preferably the mast includes a bottom bracket arranged for attachment to the ground and wherein the mast is arranged for pivotal movement about a transverse axis relative to the bottom bracket to change an angle of the drive axis relative to the ground.

Preferably the bottom bracket is attached to the ground by a bolt extending into a split sleeve contained within a drilled hole in the ground.

Preferably the vehicle is arranged for transporting sections for the auger and sections for the drill.

Preferably the vehicle is a trailer with the mast mounted at a rear of the trailer.

Preferably the vehicle has the mast mounted at a rear plate of the vehicle for pivotal movement about a pivot axis transverse to the vehicle for lying of the mast forwardly across the vehicle and for adjustment of an angle of the drive axis relative to the rear of the vehicle.

The arrangement described herein provides the capability to efficiently and effectively conduct both soil augering and diamond drilling of boreholes with a lightweight, portable drill that does not require a drill transmission or gear reduction unit. Soil augering requires higher torque, low rpm drill rotation while diamond drilling requires much less torque than soil augering but a higher rpm for productive coring. Traditional, portable drills such as the Winkie Drill, have both a two (or more) speed transmission built into the drill and a bulky, heavy gear reduction unit that is added to the drill frame to achieve the necessary torque for soil augering. In addition, drills such as the Winkie drill are labour intensive as the soil augers and drill string are raised and lowered by manual hand turning of a sprocket and chain mechanism. Transmissions are expensive to build and maintain, and repair at remote field sites is often not practical.

Another feature of the arrangement herein is the ability to efficiently maintain or replace any component in the field. Drill components are independent, that is the diesel engine, hydraulic pump and hydraulic motors are all separate, as compared to traditional units where transmission, drive motor and water swivels are housed together. Break-down of one renders the drill inoperable. Therefore repair and or replacement can be readily completed on individual components when necessary.

The arrangement described here provides an innovative method for both soil augering and diamond drilling. This is achieved by maintaining some of the desirable features of larger drill rigs such as hydraulic drive power and hydraulic control of drilling functions that reduce labour but also providing an innovative method with use of a motor box and hydraulic motors.

The arrangement described herein provides a compact, portable, hydraulically controlled and operated drill for both soil augering and rock drilling. The unit is comprised of:

a) trailer type drill carrier with capability for highway/road transport on standard tires with quick change option to high flotation all-terrain tires;

b) hydraulic controlled, lightweight and adjustable drilling angle beam support unit mounted on the trailer but also readily detachable and available for transport and drilling exclusive of the trailer carrier unit;

c) a motor box housing unit with quick change capability for hydraulic drive motors specific for the soil augering drilling application requiring higher torque, lower rotation speeds for soil augering or lower torque, high rotation speed for rock coring;

d) a fully adjustable drilling penetration rate hydraulic cylinder;

e) a hydraulic control panel.

BRIEF DESCRIPTION OF THE DRAWING

One embodiment of the invention is described in conjunction with the figures as follows.

DETAILED DESCRIPTION

Figure 1:
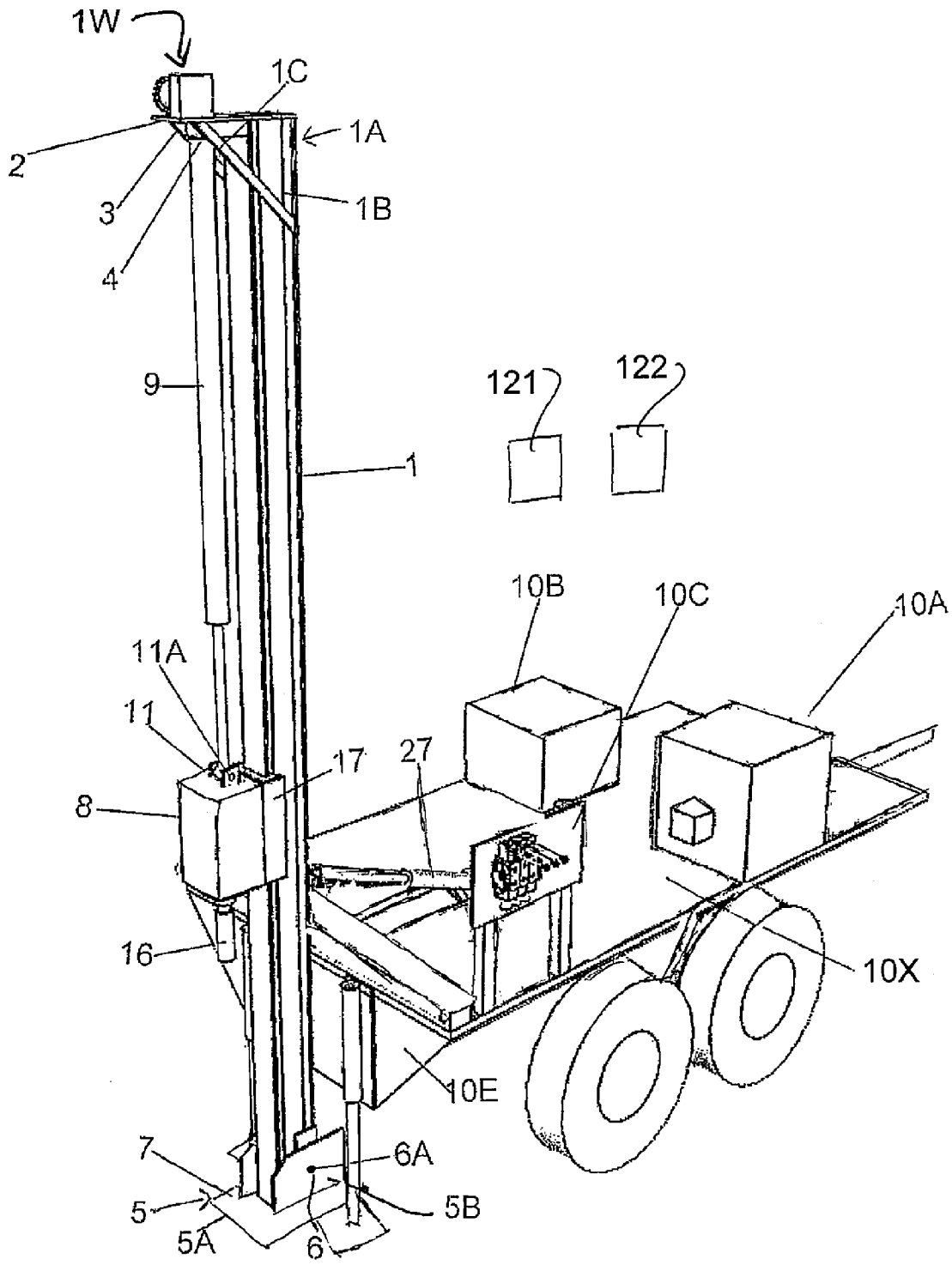
FIG. 1 is an isometric view of the main components of one embodiment of the drill rig according to the present invention including the drill mast, motor box and anchor plate.

The apparatus for use in geological exploration shown in the Figures includes a transport vehicle 10, a mast 1 carried on the vehicle 10 having a base of the mast arranged to be located at the ground, a hydraulic motor 12 carried in a motor box 8 mounted for sliding movement along the mast 1, a hydraulic cylinder 9 connected to the motor housing at one end and to a top bracket 1A of the mast at the other end for driving the housing in the sliding movement. A pump 10B is driven by an engine 10A both carried on the vehicle 10 for supplying hydraulic fluid to the hydraulic motor 12. A coupling 16 extends along a drive axis downwardly from the housing and driven by the hydraulic motor 12. The coupling is arranged for releasable attachment to an auger for driving the auger along the drive axis into the ground for extracting an augered soil sample and being arranged for releasable attachment to a diamond core drill for drilling into the ground along the drive axis to extract a core sample.

There is provided a first motor 121 for the auger and a second motor 122 for the drill (both shown schematically in FIG. 1) where the first motor has a lower rate of rotation and higher torque than the second motor so that the motor is changed when changing from the auger to the drill.

Figure 5:
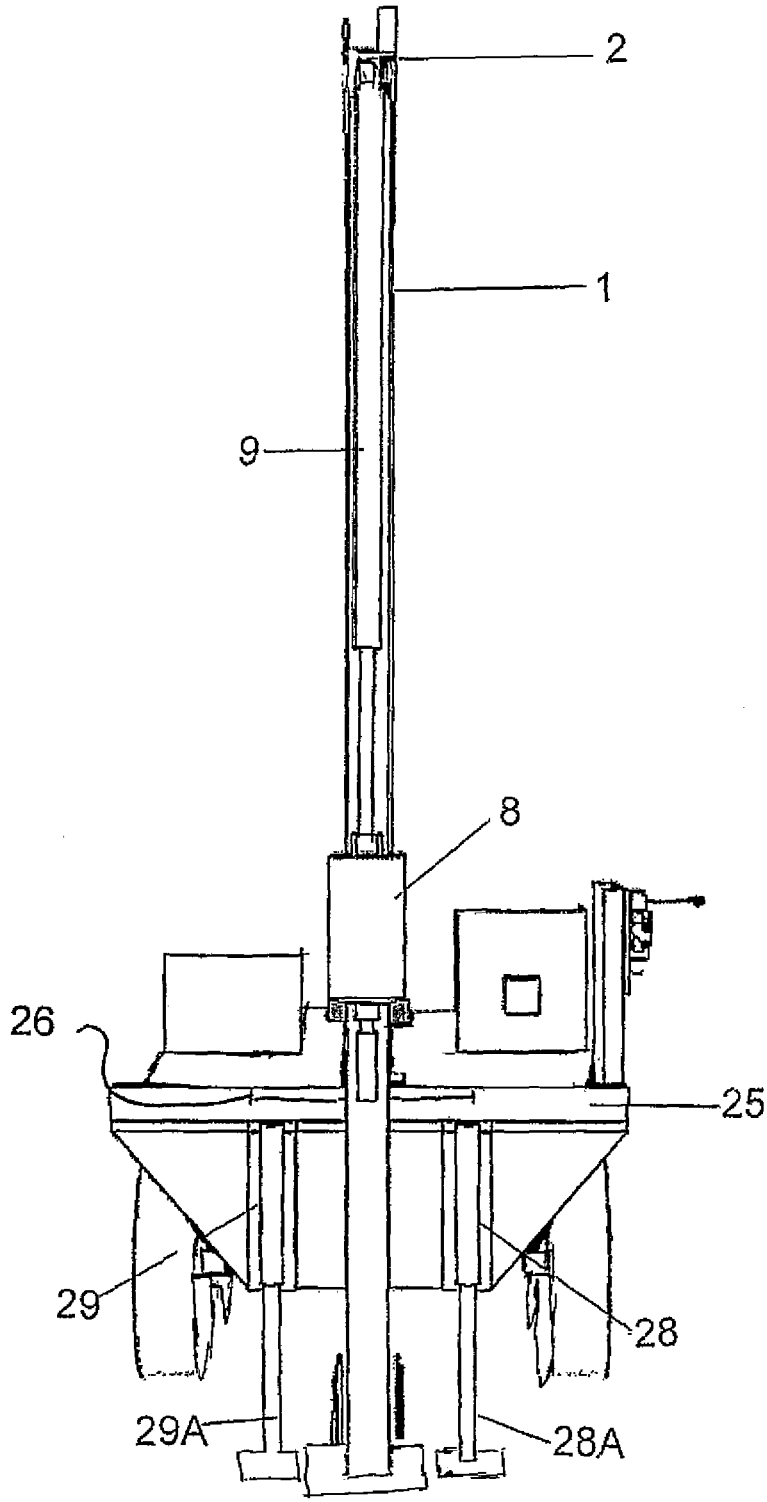
FIG. 5 is a rear view of the all-terrain carrier or trailer, mast pivot mounting and jack stands of the drill rig of FIG. 1.
Figure 6:
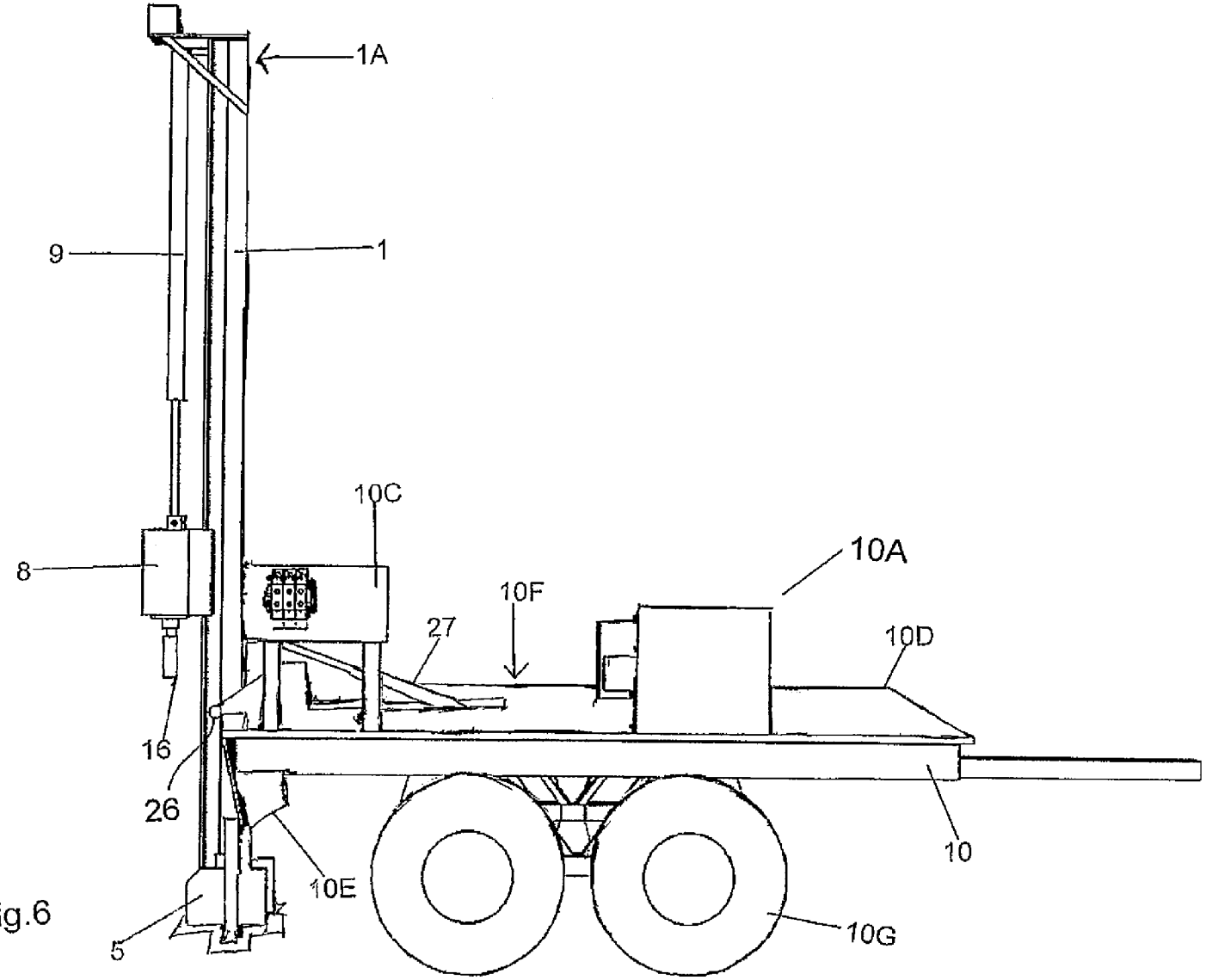
FIG. 6 is a side elevational view of drill components, mast, hydraulic control panel, diesel engine, hydraulic oil reservoir and drill carrier of the drill rig of FIG. 1.

The drill mast 1 in FIGS. 1, 5 and 6 is constructed of an aluminum I-beam with a top bracket 1A defined by a planar top plate 2 welded to the end of the beam. The plate 2 is reinforced with angled support gussets 3 to provide a stable bracket 1A that can connect to the hydraulic cylinder 9 and accommodate force from the cylinder 9 used to lift and lower the drilling components, that is the soil augers and diamond drill rods and attachments. The top bracket 1A also has additional side brackets 1B with bored holes 1C through the reinforced bracket to allow for the coupling of a hydraulic cylinder to the bracket. A removable pin 4 joins the cylinder to the bracket to facilitate easy removal of the hydraulic cylinder.

The mast further includes at the bottom an anchor plate 5 including a main base plate 5A which has been reinforced by welded angle brackets 5B. A bored pivot hole 6 extends through the brackets 5B so that the anchor plate is fastened to the mast by a removable pivot pin 6A. The pivot point at the pivot pin 6A allows the mast to be inclined forwardly and rearwardly relative to the base plate 5A at angles from 0 to 90 degrees thus facilitating angled borehole drilling at an angle to the ground. This is often preferred and necessary as boreholes are drilled in a manner to try intersect mineralized zones. Anchoring of the base plate 5A and therefore of the mast 1 is necessary for diamond drilling procedures to prevent movement and off-set of the drill rig. This ensures and maintains proper alignment of the drill mast, drill rods, core barrel and the motor box 8 with the borehole. Failure to keep the drill string in alignment results in drill vibration, additional drill rod wear and impingement of the drill rods as they are lowered or removed from the borehole.

The drill mast can be securely anchored by drilling a short auxiliary borehole of the order of 0.3 m in depth adjacent to the main borehole prior to drilling the borehole and inserting a split steel sleeve into the auxiliary borehole and through the anchor plate 5A. A bolt within the split sleeve is then tightened which forces the split sleeve against the auxiliary borehole walls to provide a secure bolt anchor. The bolt in turn extends through the anchor plate 5A and another bolt is tightened onto the top of the anchor plate 5A to securely fasten the base plate and drill mast to bedrock.

Figure 2:
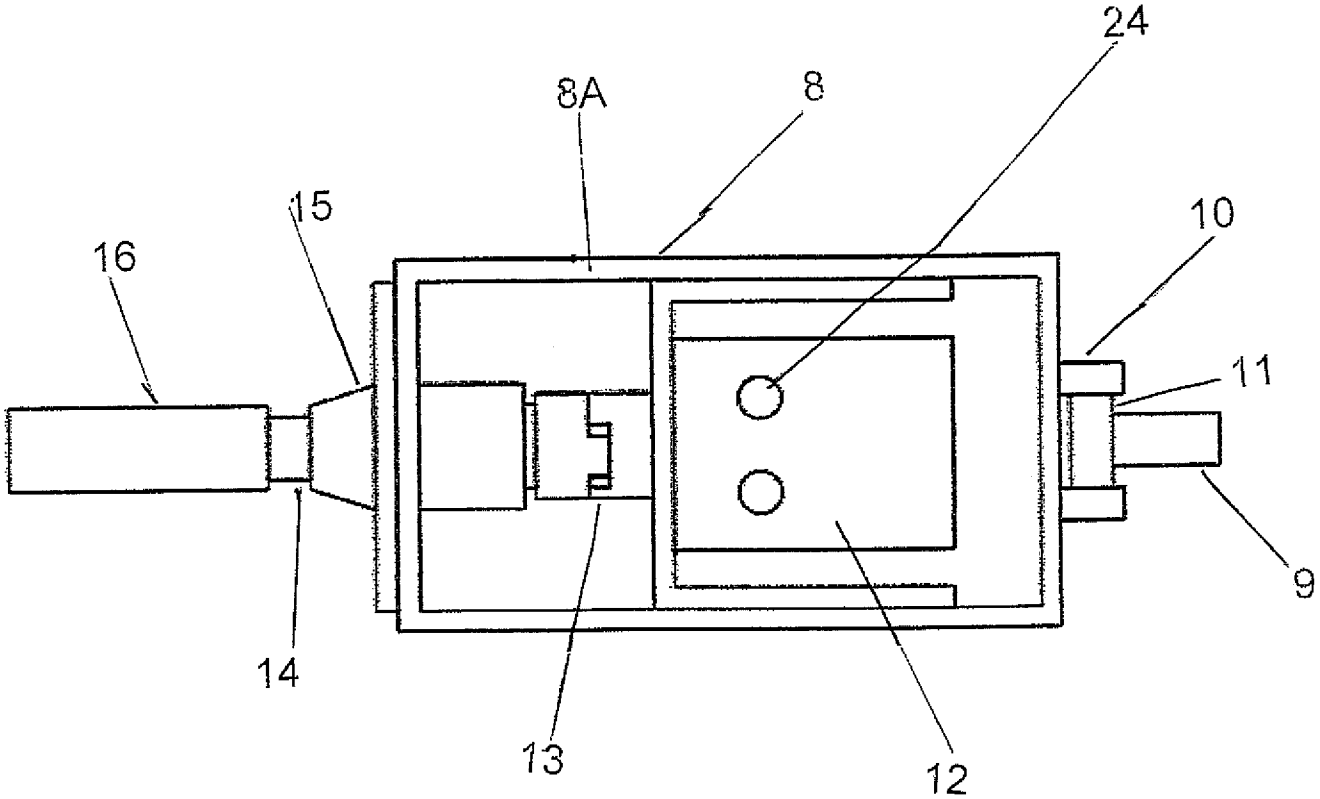
FIG. 2 is a front elevational view of the motor box of the drill rig of FIG. 1.
Figure 3:
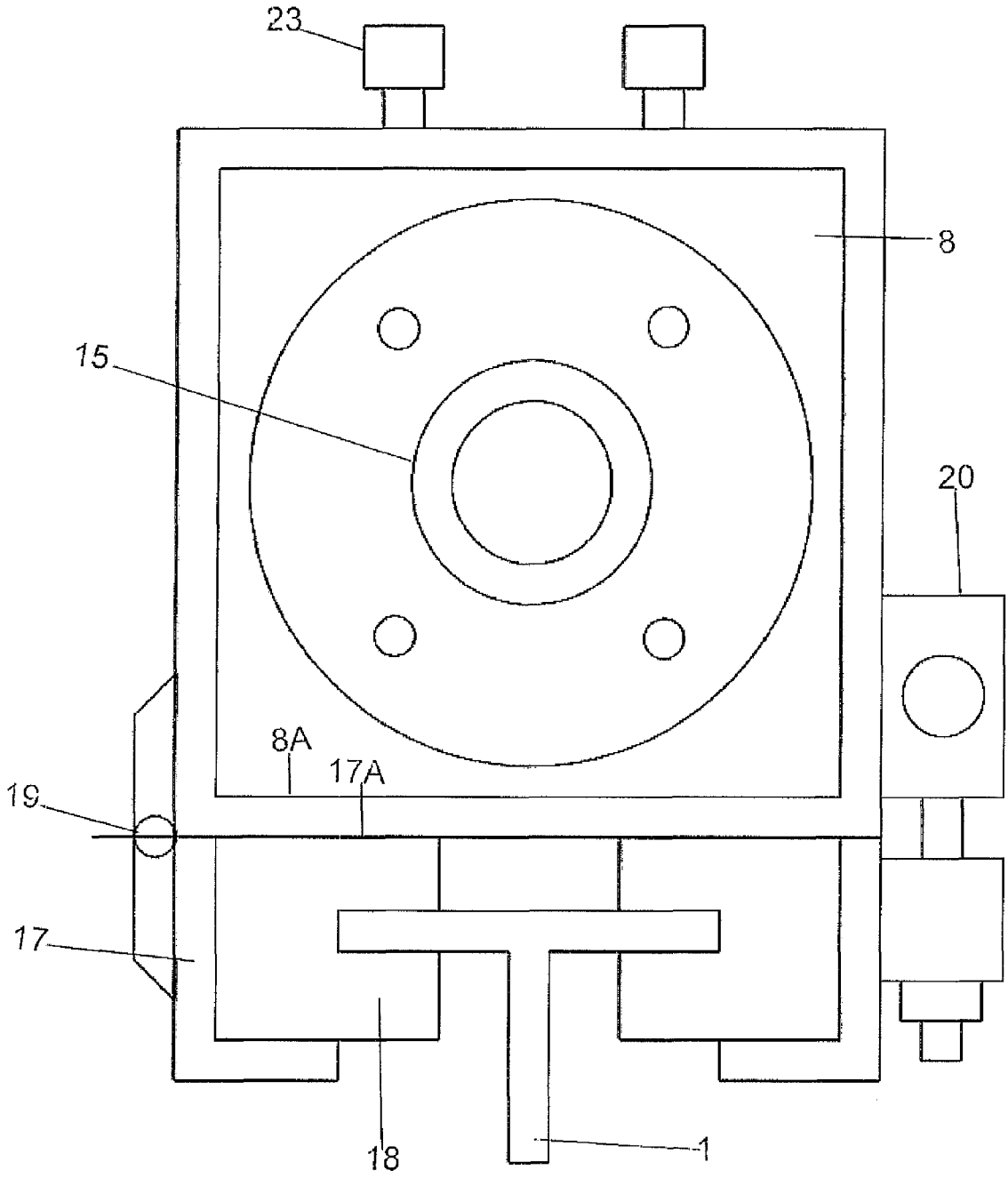
FIG. 3 is a bottom plan view of the motor box of the drill rig of FIG. 1.

FIG. 2 illustrates the motor box which is coupled to a hydraulic cylinder 9 that controls the penetration or downward feed rate for both soil augering and diamond drilling. The motor box is coupled to the feed cylinder 9 with a welded aluminum bracket 11 and a removable pin 11A. This method of coupling of the two components allows for quick and easy de-coupling of the motor box 8 and cylinder 9 for either transport or for drilling operations, such as auger or drill string retrieval.

The motor box 8 provides a housing 8A for a hydraulic motor 12 connected by a motor drive shaft 12B to a flexible coupling 13 for a drive shaft 14 and a thrust bearing 15 which in turn attaches to the coupling 16 provided by a hex adapter box that couples to the soil augers and the diamond drilling rods. The motor box 8 also has a separate base 17 that is fitted with notched polyethylene sliders 18 which act as spacers that allow the motor box to slide up and down on the I-beam aluminum mast 1. The notched polyethylene insert 18 allows for relatively friction free slide action as the motor box 8 and drill string are extended or retracted as drilling operations proceed.

The motor box 8 is also affixed to the motor box base 17 by an aluminum hinge 19 providing a vertical axis on one side of the housing bridging the butting faces 17A and 8B of the base 17 and housing 8A allowing the pivotal movement of the housing away from the mast while the base 17 remains attached to the mast. A set of aluminum latches 20 on the opposite side of the motor box hold the housing closed against the base 17 but can be released to allow the housing to move away from the mast. This hinge allows the motor box 8 to be swung open and to the side of the mast to allow efficient retrieval by hoisting of soil augers or diamond drilling rods using a winch 1W coupled to the top of the mast. Thus with the motor box and coupling removed to one side the cable from the winch can pull along the line of the drill axis and remove the soil augers or diamond drilling rods while pulling them along their length.

By unlatching the two bolts on the motor box housing, to decoupling the hydraulic cylinder 9, this allows retrieval of up to 3 meters length of drill rods or soil augers in one stroke up to the top of the mast. This significantly increases efficiency, reducing labour and increasing productivity when hoisting longer lengths of drill rod or augers from deeper boreholes.

The motor box also serves as an additional purpose and that is providing a housing or support box for the thrust bearing 15, which transfers the stress and load of the soil augers and drill strings to the hydraulic cylinder 9 which in turn is coupled to the top bracket of the mast 1. This also allows the hydraulic motor 12 to be free of any external load apart from the required torque and prevents pressure forces from impinging on the hydraulic motor shaft, shaft seals and bearings of the hydraulic motors.

Figure 4:
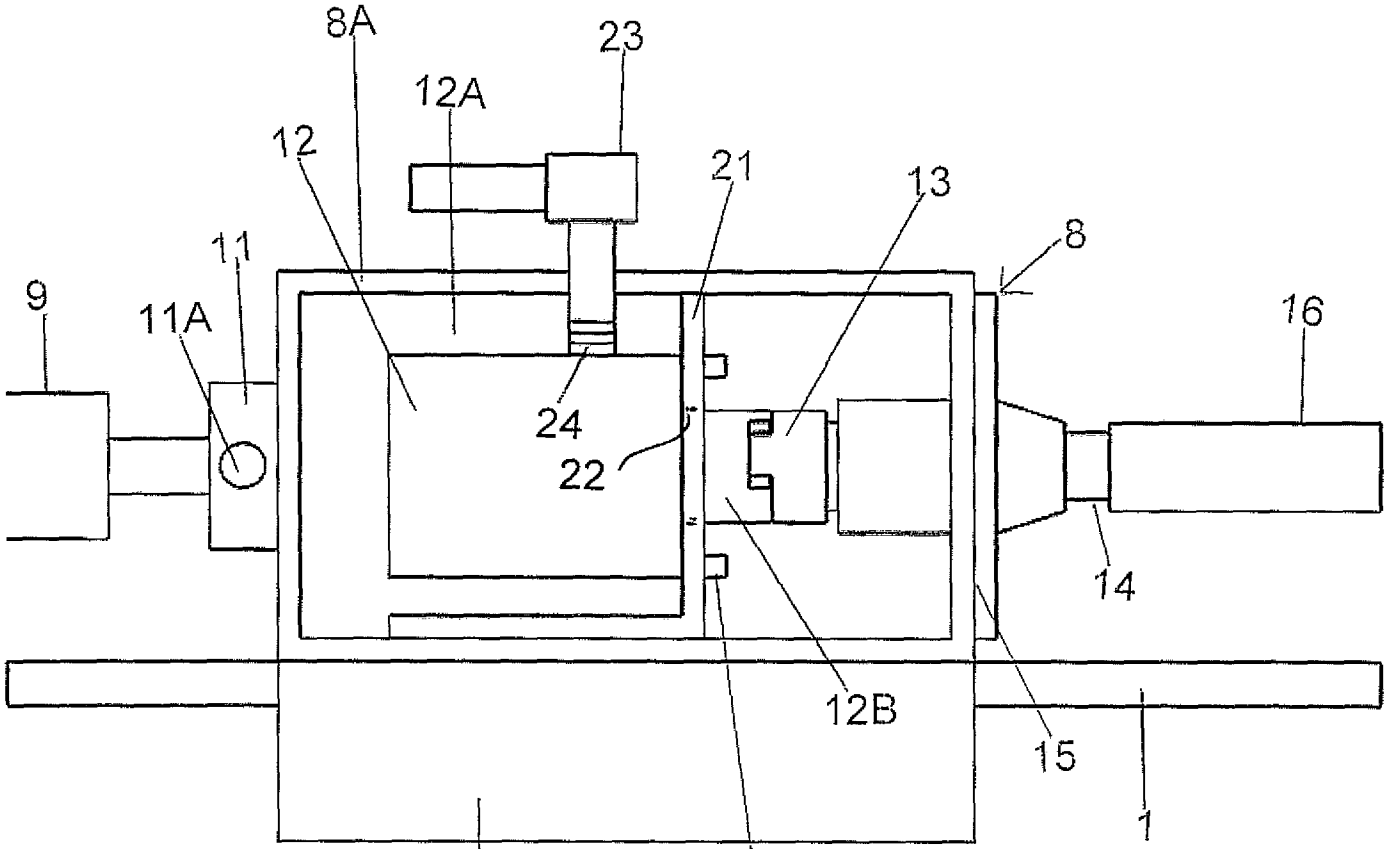
FIG. 4 is a vertical cross sectional view along the lines 4-4 of FIG. 3 of the motor box of the drill rig of FIG. 1.

As shown in FIG. 4 there is a hydraulic motor mount box 12A that fits tightly inside the housing 8A. The inside box 12A to which the hydraulic motor is bolted has an access opening 22 in a bottom plate 21 through which the motor drive shaft 12B of the hydraulic motor 12 extends. The hydraulic motor drive shaft 12B is coupled by flexible spider couplers 13 to the drive shaft 14 which in turn extends through the thrust bearing 15 and bearing housing. Hydraulic hose lines 23 are connected, through the motor box cover, to the two ports 24 of the motor 12. One port receives pressurize hydraulic fluid from the hydraulic pump 10B driven by an internal combustion engine 10A, while the opposite port returns the fluid to the hydraulic control panel 10C which is then returned to the hydraulic reservoir 10D.

The hydraulic motor 12 selected for soil augering or diamond drilling is a standard industrial size and therefore completely inter-changeable with other replacement motors, often of a different capacity. The hydraulic motor 12 can be selected by torque, volume and rotation specification to match drilling requirements of the auger and drill and rock or soil conditions. A wide range of torque, volume and rpm hydraulic motors are available from most hydraulic service firms. Soil augering requires higher torque and lower rpm motors to turn the auger string in the high friction soils while best results for diamond drilling is achieved with higher rpm of the drill bit and core barrel. The rotation rates can also be further controlled by speed of the diesel engine 10A and the hydraulic valve controls 10C.

The hydraulic motor 12 is mounted in the container 12A within the motor housing 8A by easily accessible bolts this allows for quick and easy change of hydraulic motor. However, it should be noted that normally only one motor is required for soil augering for example 0 to 200 rpm and a single change to a second higher rpm hydraulic motor for diamond drilling for example 1000 to 2000 rpm. The change of one hydraulic motor to another can be made in a matter of minutes.

As such, efficient drilling of both soils and diamond drilling can be achieved with a lightweight portable drill without the need for an expensive, heavy and cumbersome transmission and/or add-on auger unit reduction gears. In addition, hydraulic motors used for these operations are inexpensive, typically in the range of 200 to 500 dollars.

In FIG. 5 is shown a rear-view of the drill mast, and an aluminum channel box 25 and an aluminum pivot mounting 26 that attaches the drill mast 1 to the rear face of the all terrain trailer 10. The horizontal pivot mounting 26 consists of a heavy walled pipe that is welded to the mast and two channel brackets attached to the box 25 and is secured by a pipe-type pin that allows the mast to be pivoted about the horizontal axis of the mounting 26 by activation of a hydraulic cylinder 27 connected between the mast and the trailer 10 that controls the angle of the mast. For travelling the mast is positioned horizontally laid across a support plate 10X of the trailer 10 between the motor 10A and the pump 10B. For soil augering, the mast it tilted by the cylinder 27 to an upright position. As previously described the drill mast can be positioned at any angle between 0 and 90 degrees for diamond drilling. The pin of the pivot 26 is also constructed for easy removal for disengagement from the trailer 10 should it be necessary to independently transport the aluminum mast, motor box and cylinder, for example in a cargo plane transport.

The reinforced and adjustable jack stands 28 and 29 located at the rear face of the trailer 10 are deployed during set-up at a drilling or soil augering location. The jack stand legs 28A, 29A are independently adjustable to accommodate field terrain irregularity and are fastened with a retractable pin to facilitate easy adjustment and retraction for travel. The jack stands can be made of aluminum and are bolted to a main upstanding rear wall 10E of the trailer to provide a stable platform during drilling operations.

FIG. 6 shows a side view of the carrier trailer 10 including the primary mover or engine 10A and hydraulic fluid reservoir 10D for the pump 10B. Also shown is the hydraulic control panel 10C.

The trailer is specifically designed for transport of the drill and drill tools and for travel pulled by a 4 wheel All-Terrain Vehicle on terrain typical of the Canadian Shield. The All-terrain carrier 10 has a flat deck 10X for work surface and drill mount and a centre storage at a dropped section 10F that houses the mast control cylinder 27 and storage and transport of augers and other drilling equipment. The tandem wheel configuration of the wheels 10G has large all-terrain type, low pressure wheel assemblies installed for additional flotation and travel in swamp-type terrain. The drill carrier is also constructed for highway travel and off road tire assemblies can be removed and replaced with on-road type wheels. Another feature of the trailer is the mounting of the tandem wheels. The wheels are mounted directly to the side of the reinforced trailer frame. This eliminates the need for an axle running beneath the trailer and thus reduces trailer carriage profile, resulting in fewer hang-ups on stumps, rocks or brush while travelling off-road.

The directional control valves of the control 10C allow for a wide range of speed and directional control for:

1) tilting the mast 1 to horizontal positions for transport on the AT carrier and for vertical to angled position for soil augering and diamond drilling. The hydraulic control valves in conjunction with the hydraulic cylinder activation allows for positioning the mast and for drilling boreholes at any angle between horizontal and vertical. Angled boreholes are most often drilled to try intersect mineralized zones which often are tabular and occur in a vertical or near-vertical sheet. As such, capability to drill a wide range of angled boreholes is a valuable feature for mineral exploration.

2) controlling the rate of soil auger or rock coring. For soil augering the depth and type of soil dictates the rate of penetration and may range from cms to meters/minute. For soft organic-rich soils the penetration rate is rapid and the ability to quickly extend the cylinder 9 increases productivity. Conversely for dense, firm soils such as some tills or lake clays, the augering rate may be significantly reduced and ability to control the downward penetration rate is important, so as to not overload the engine, overheat the hydraulic fluid or cause undue stress on the drill mast and other components. For these reasons it is advantageous to have a fully controllable hydraulic cylinder 9 to dictate even and smooth drilling operations.

3) Control of auger and drill bit rotation speed. Integral to the drill rig efficiency and reliability is the control of soil auger and drill bit rotation speed. This is controlled and also dependent on 2 above, penetration rate, and optimization of drill performance. Drilling productivity is a balance between these two functions. For this invention, a wide range of torque and drill speed is achieved by selecting and installing the hydraulic motor 12 that best provides the torque or torque and speed required. For example, for soil augering, soil auger rotation speeds of 0-200 rpm are suitable and selected for these operations. These hydraulic motors have a higher hydraulic volume intake/rpm motors and thus provide the increased torque needed for soil augering. In addition to the hydraulic motor specifications the hydraulic control allows for control of the rotation speed from near zero to the maximum rpm specified for the hydraulic motor. For diamond drilling, efficiency in rate of penetration is gained by having a higher bit rotation speed (1000-2000) rpm and a lower torque requirement. This is because the friction on the drill rods in a water filled borehole is much less than soil augers rotating in dense, firm and plastic soils where considerably more torque is required to rotate the auger string.

The invention claimed is:

1. Apparatus for use in geological exploration comprising:

a transport trailer having a rear plate and a top platform;

a mast carried on the trailer having a base of the mast arranged to be located at the ground;

a diamond core drill for drilling into the ground along the drive axis to extract a core sample;

an auger for driving along the auger along the drive axis into the ground for extracting an augered soil sample;

a motor housing mounted for sliding movement along the mast;

a first hydraulic motor for driving the auger and a second hydraulic motor for driving the drill where the first motor has a lower rate of rotation and higher torque than the second motor so that the motor is changed when changing from the auger to the drill;

the motor housing being arranged to receive carried therein a selected one of the first and second hydraulic motors so that the selected one of the first and second hydraulic motors is inserted into the housing and the other of the first and second hydraulic motors is removed from the housing depending on whether the diamond core drill or the auger is selected to be driven;

a hydraulic cylinder connected to the motor housing at one end and to a top bracket of the mast at the other end for driving the housing in the sliding movement;

a pump driven by an engine both carried on the trailer for supplying hydraulic fluid to the hydraulic cylinder and to the selected one of the first and second hydraulic motors;

and a coupling extending along a drive axis downwardly from the motor housing and driven by said selected one of the first and second hydraulic motors in the housing;

the coupling being arranged for releasable attachment to said auger for driving along the auger along the drive axis into the ground for extracting an augered soil sample and being arranged for releasable attachment to said diamond core drill for drilling into the ground along the drive axis to extract a core sample.

2. The apparatus according to claim 1 wherein motor housing includes an inner motor support into which the motor can be inserted.

3. The apparatus according to claim 1 wherein motor housing includes a transverse mounting plate onto which said selected one of the first and second hydraulic motors is mounted and includes a bottom mounting plate parallel to and spaced from the transverse plate to form a compartment for containing a flexible coupling for the motor.

4. The apparatus according to claim 1 wherein the motor housing includes a bottom plate onto which is mounted a thrust bearing for receiving thrust forces from the coupling when driving the auger or the diamond core drill.

5. The apparatus according to claim 1 wherein the motor housing is mounted for pivotal movement about an axis along the mast so as to move the housing and said selected one of the first and second hydraulic motors therein away from the drive axis to allow upward pulling of the selected one of the auger and diamond core drill along the drive axis for extraction.

6. The apparatus according to claim 1 wherein the mast includes a bottom bracket arranged for attachment to the ground and wherein the mast is arranged for pivotal movement about a transverse axis relative to the bottom bracket to change an angle of the drive axis relative to the ground.

7. The apparatus according to claim 1 wherein the trailer is arranged for transporting sections for the auger and sections for the drill.

8. The apparatus according to claim 1 wherein the trailer has the mast mounted at a rear plate of the vehicle for pivotal movement about a pivot axis transverse to the trailer for lying of the mast forwardly across the trailer and for adjustment of an angle of the drive axis relative to the rear of the trailer.

* * * * *